United States Patent [19]

Ulm

[11] Patent Number: 4,874,023

[45] Date of Patent: Oct. 17, 1989

[54] DECAP DISPENSING SYSTEM FOR WATER COOLER BOTTLES

[75] Inventor: John G. Ulm, Upper Sandusky, Ohio

[73] Assignee: Liqui-Box Corporation, Worthington, Ohio

[21] Appl. No.: 251,267

[22] Filed: Sep. 30, 1988

[51] Int. Cl.[4] ..... B65B 3/04

[52] U.S. Cl. ..... 141/346; 141/349; 141/351; 141/286; 141/364; 222/146.6; 62/389

[58] Field of Search ..... 141/346, 347, 348, 349, 141/350, 351, 352, 353, 354, 357, 360, 363, 364, 319, 320, 321, 285, 286, 383, 384, 387, 1, 82; 62/389, 391; 222/146.6; 312/236

[56] References Cited

U.S. PATENT DOCUMENTS

| | | | |
|---|---|---|---|
| 488,473 | 12/1892 | Fruen | 141/352 |
| 497,896 | 5/1893 | Ruppel | 141/349 X |
| 738,712 | 9/1903 | Cole | 141/349 X |
| 996,127 | 6/1911 | Patnaude | 141/363 X |
| 1,018,924 | 2/1912 | Patnaude | 141/364 X |
| 1,931,973 | 10/1933 | Zerk | 141/357 X |
| 2,881,810 | 4/1959 | Breitenstein | 141/349 X |
| 2,989,091 | 6/1961 | Lowenthal | 141/349 X |
| 3,343,718 | 9/1967 | Siegel et al. | 141/349 X |
| 4,253,501 | 3/1981 | Ogle | 141/286 X |
| 4,356,848 | 11/1982 | Spies | 141/349 |
| 4,421,146 | 12/1983 | Bond et al. | 141/349 |
| 4,444,551 | 5/1984 | Bond et al. | 141/349 |
| 4,699,188 | 10/1987 | Baker et al. | 141/286 X |

*Primary Examiner*—Ernest G. Cusick

*Attorney, Agent, or Firm*—William V. Miller; Sidney W. Millard

[57] ABSTRACT

A system for supplying liquid in large bottles from a point where they are filled to a dispenser having a reservoir for receiving the liquid. The bottles each have a neck which carries a cap unit for closing the spout thereof. Each cap unit has an outlet valve that is normally closed. The reservoir has means for supporting another normally closed inlet valve in a neck-receiving socket. When the neck is slipped into the socket the outlet valve of the cap unit is opened and substantially simultaneously the inlet valve for the reservoir is opened thus allowing flow of water form the bottle into the reservoir. When the bottle is removed from the reservoir as the cap unit is withdrawn from the neck-receiving socket, the outlet valve in the bottle neck cap unit is positively closed and the inlet valve of the reservoir automatically closes.

18 Claims, 5 Drawing Sheets

DECAP DISPENSING SYSTEM FOR WATER COOLER BOTTLES

BACKGROUND OF THE INVENTION

This invention deals with water or other liquid dispensers of the commercial type each of which has a reservoir from which the cold or hot water is dispensed. The water is supplied in a large bottle which is inverted over the reservoir so that the water flows through the spout of the bottle neck into the reservoir. For delivery and storage now the neck is provided with a sample cap. At the present time this cap must first be removed and the bottle is then inverted and positioned over the reservoir in communication therewith. The filled bottles are very heavy and as the bottles are inverted it is usual to hold the hand over the spout to prevent loss of substantial amounts of the water. This is difficult to do and is not sanitary. The empty bottles are turned with the spout in the neck open which is unsanitary and makes them more difficult to clean and sanitize.

SUMMARY OF THE INVENTION

The present invention deals with a system whereby the water dealer can supply the water in large capped bottles each of which is closed completely and sanitarily by an outlet-slider valve in a cap applied to the neck thereof that is only opened at the time of inverting the bottle and mounting it on the water dispenser reservoir. The top of the reservoir is closed by a cover or bottle-supporting plate which is provided with an upwardly-opening cup-like bottle neck receiving and supporting socket which receives and seals within it the depending valve-carrying cap on the inverted bottle. This socket carries an inlet valve which comprises a slide stem valve carrying a valve that is normally closed to seal the reservoir. As the capped bottle is inserted in the socket, the stem engages the normally-closed outlet-slider valve in the bottle cap and opens it to permit flow of water from the bottle and substantially simultaneously or an instant before, opens the reservoir sealing inlet valve to permit flow into the reservoir. When the bottle is empty and is removed by withdrawing it from the bottle neck receiving socket, the slider valve in the socket automatically closes and the stem positively activates the slider valve in the cap collar to positively close it. Thus, the bottle is positively closed before return to the dealer. Consequently, the bottle is sealed from the time of leaving the dealer when it is filled to the time of returning to the dealer empty so as to maintain sanitary conditions at all times.

BRIEF DESCRIPTION OF THE DRAWINGS

The best mode contemplated in carrying out this invention is disclosed in the accompanying drawings in which.

DETAILED DESCRIPTION OF THE DRAWINGS

Figure 1:
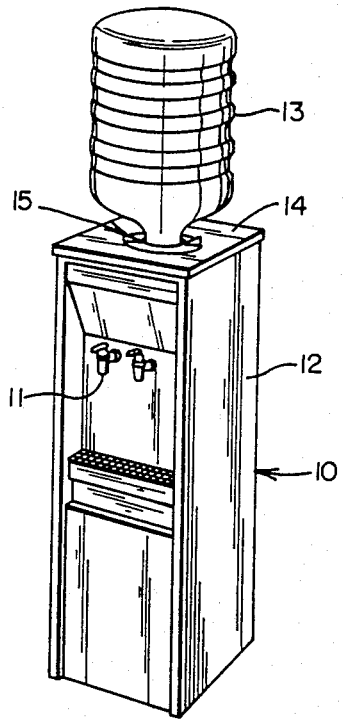
FIG. 1 is a perspective view showing a liquid dispenser to which the invention is applied.
Figure 3:
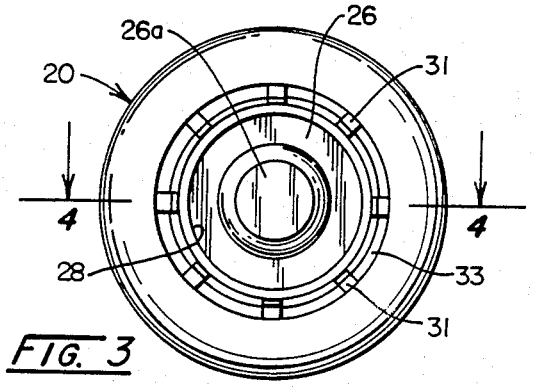
FIG. 3 is a top view of FIG. 2.
Figure 3A:
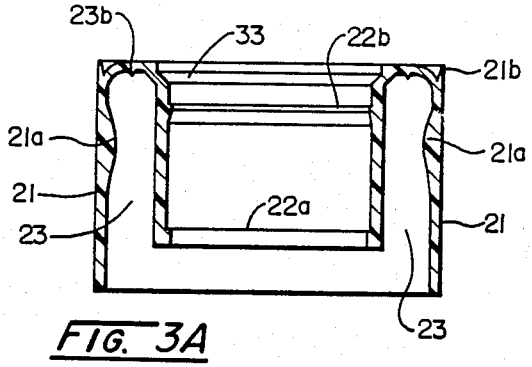
FIG. 3A is a sectional view of the socket part of the cap.

With reference specifically to the drawings, FIG. 1 shows a liquid dispenser 10 as an example of an application of this invention. This dispenser may be of a type to cool or heat water or both and to dispense it through faucets such as 11 connected to a reservoir within the cabinet 12. Water or other liquid is supplied by large plastic or glass bottles 13 each of which is successively inserted and mounted on a cover and support plate 14 at the top of the cabinet. This plate carries a bottle neck receiving socket and reservoir inlet valve unit indicated generally by the numeral 15 which is located directly over the liquid or water reservoir 16 shown in FIGS. 6, 7 and 8. The reservoir is supported in the usual manner within the cabinet 12.

Figure 4A:
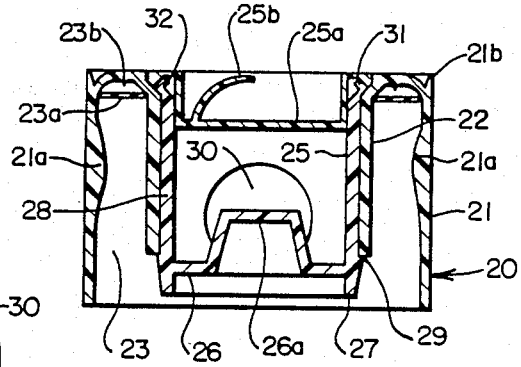
FIG. 4A is a sectional view of the assembled cap.
Figure 2:
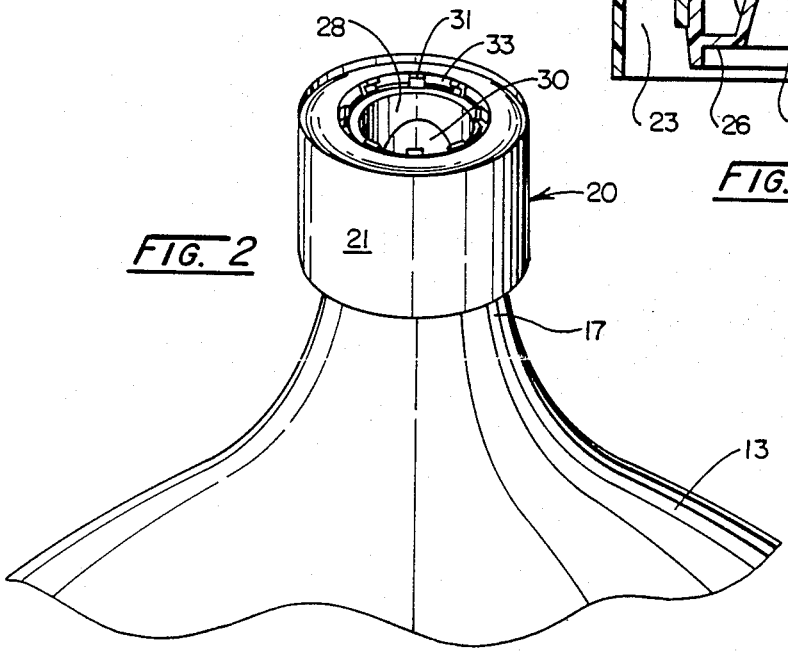
FIG. 2 is an enlarged view of the neck portion of one of the bottles with the cap and valve assembly of the invention applied thereto.
Figure 4:
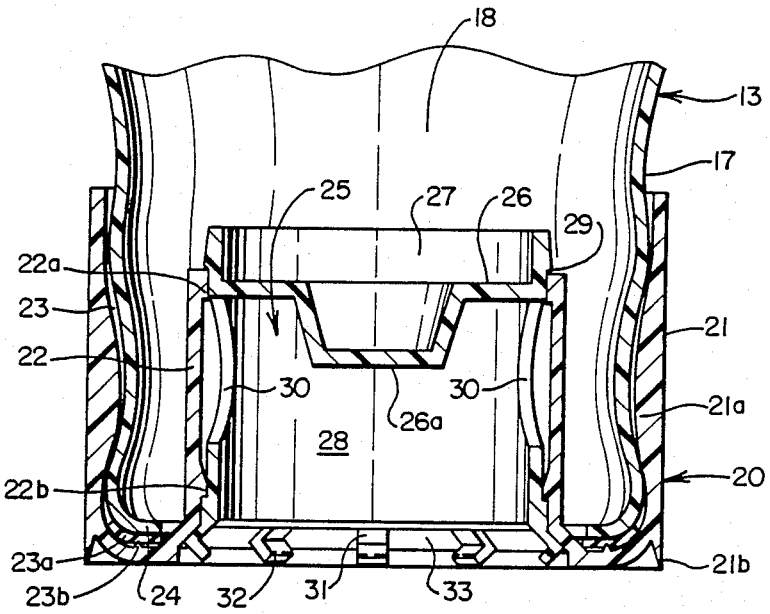
FIG. 4 is a cross section taken along 4—4 of FIG. 3.
Figure 6:
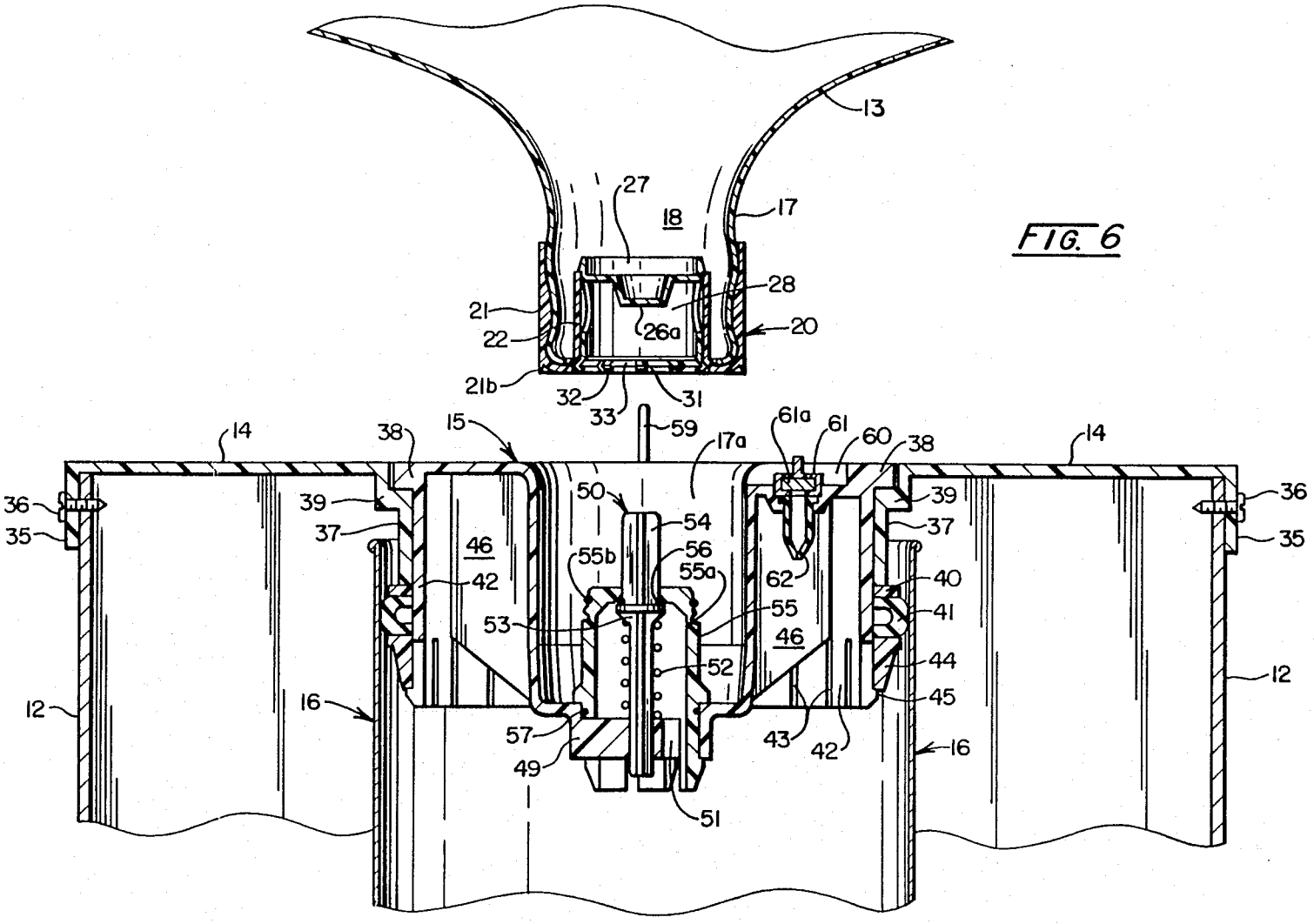
FIG. 6 is an enlarged sectional view taken along line 6—6 of FIG. 5 showing the capped bottle being inserted in the well or socket on the reservoir.
Figure 7:
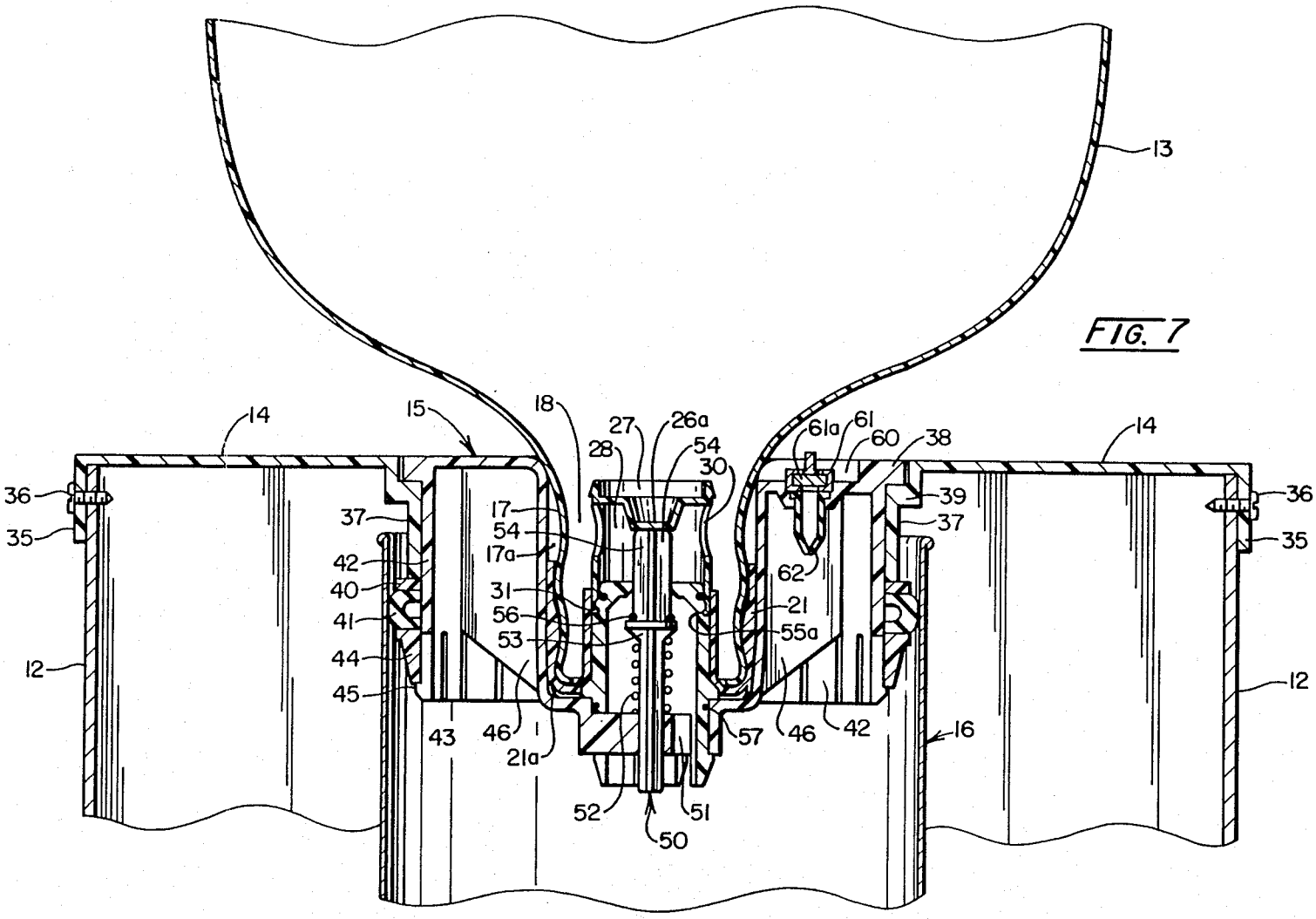
FIG. 7 is a similar view showing the inserted bottle in the receiving socket on the reservoir.

The bottle 13 to be inserted in the dispenser 10 is of the usual form having an elongated neck 17 which has a spout 18 which is open at the time of filling the bottle. After filling, the neck 17 receives a cap unit and outlet valve assembly indicated generally by the numeral 20. This assembly is preferably of plastic and is shown best in FIGS. 2 to 4 and 4A. It comprises an outer flexible collar or skirt 21 which supports an inner concentrically-spaced axially shorter valve guide skirt 22 to provide an axially inwardly opening circular neck-receiving socket 23 which is adapted to frictionally receive and seal hermetically the bottle neck as it engages the seal at the closed inner end of the socket (FIG. 4). This seal includes the inner end of socket 23 at a flexible sealing ring **23*a* which is adapted to be pushed into contact with a small sealing rib 23*b* as the lip flanged 24 of the neck reaches the inner end of the socket. Skirt 22 has an annular stop 22*a* at its inner edge and also has an internal sealing rib 22*b*. Skirt 21 has an inner friction-producing tapered surface 21*a* and also has an outer flexible sealing lip 21*b* adjacent thereon. Within the guide skirt 22 a slider valve 25 is mounted for axial movement. This valve is similar to that disclosed in U.S. Pat. Nos. 4,421,146 and 4,445,551. It includes a closed inner wall 26 which carries an inwardly-extending annular flange 27 and an outwardly-extending annular skirt 28 which forms the annular body of the valve member. Adjacent to the flange 27 is an outer stop shoulder 29 which, when the valve body 28 is in closed position, engages the inner extremity of the skirt 22 to stop the valve in that position FIG. 4*a*. The wall 26 carries an axially-outwardly extending valve stem engaging protuberance 26*a* centrally thereof. The valve body 28 has outflow orifices 30 formed therein which are within skirt 22 when the valve body 28 is in its closed position within the skirt. The valve body 28 is normally held in this closed position by resilient gripping fingers 31 which are resiliently carried at angularly-spaced positions on the outer extremity of the valve body 28. In the closed position of the valve body shown in FIGS. 4A and 4 the fingers swing radially-outwardly into contact with an annular cam surface 33 on the outer extremity of the valve guide skirt 22. The outer end of each gripping finger 31 has a valve stem engaging shoulder 32 which is adapted to swing radially-inwardly into a locking groove 55***a* (FIG. 6) on a valve stem guide 55 secured in the neck receiving socket 17*a* which will be referred to later. The resilient fingers 31 normally extend outwardly into contact with the annular cam surface 33 when the valve body is closed (FIG. 4); but if the valve body is pushed axiallyinwardly to open position they will be constricted radially inwardly (FIG. 7) as they are moved axially inwardly into the valve guide skirt 22 and will have their locking ends 32 positioned in groove 55*a* of valve stem guide 55 over which valve body 28 slides (FIG. 7). An O-ring seal 55*b* is provided at the outer end of guide 55 for sealing with valve body 28 when in closed position.

Figure 8:
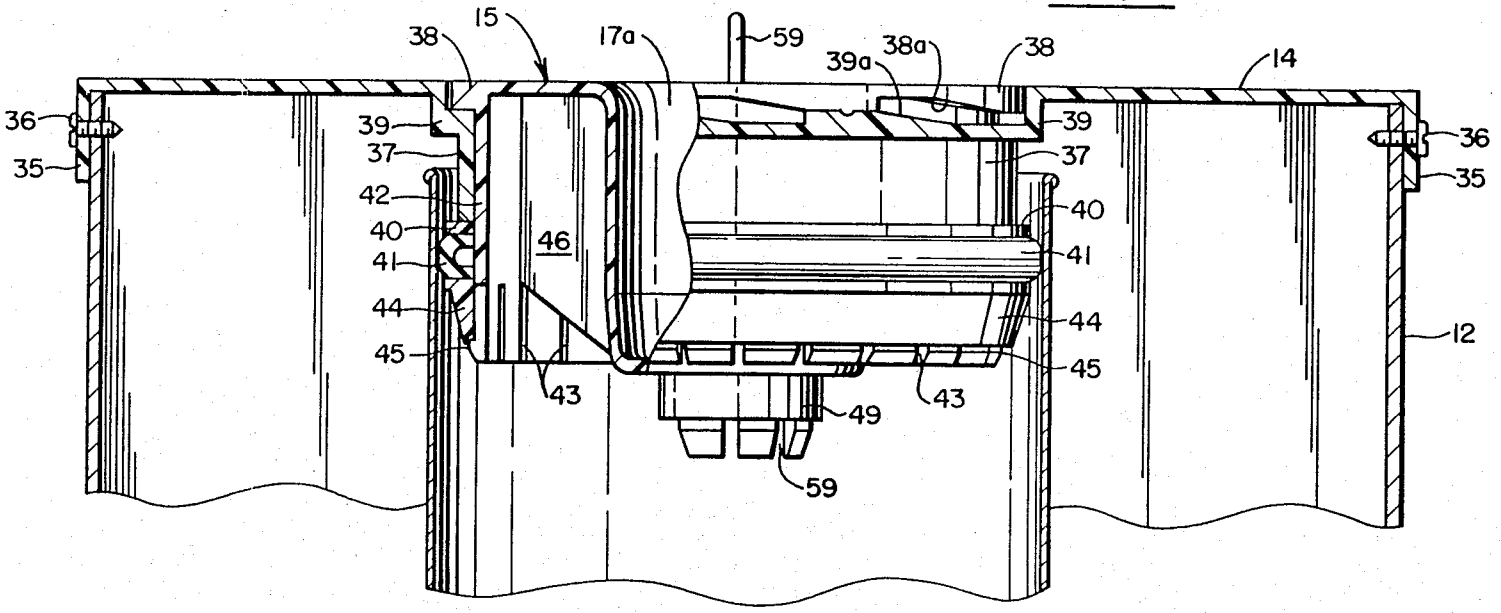
FIG. 8 is a partial sectional view of the bottle-receiving socket and valve assembly on the reservoir which is shown more in section in FIG. 6.

As indicated, the cover and support plate 14 supports the bottle neck 17 in association with the reservoir 16 as shown in FIG. 7. This plate 14 has a depending peripheral flange 35 which extends downwardly into overlapping relationship with the wall of cabinet 12 and may be secured thereto by screws 36 as shown in FIGS. 6, 7 and 8. This plate supports the bottle neck socket and associated reservoir inlet valve assembly unit 15 as previously indicated. This unit, which is preferably of plastic, fits within a centrally disposed annular flange 37 depending from plate 14 and comprises an upper ring 38 which rests in an annular recess 39 formed in the plate 14 around the opening therein which is above the reservoir 16. It will be noted (FIGS. 6 and 7) that the flange 37 is concentric with and depends into the reservoir 16 with its lower edge in engagement with a gasket-compressing ring 40 which engages with an annular C-shaped compressible gasket 41. The gasket opens inwardly to tightly embrace the skirt 42 carried by ring 38 and which depends into the reservor 16 and tightly fits within the flange 37. The skirt 42 depends through the flange 37 and has angularly-spaced vertical slits 43 in its lower extremity which aid in insertion of the skirt into and through the flange 37. These slits also facilitate positioning of the ring 40 and the U-shaped gasket 41, on the skirt 42, along with a gasket positioning ring 44 fixed on the lower slit part of the skirt 42. The gasket rests on the flat upper support surface of the ring which has a tapered face and normally is prevented from downward axial movement by a shoulder 45 on skirt 42 over which it is snapped, along with ring 40 and the gasket 41, in initially assembling these members.

Figure 5:
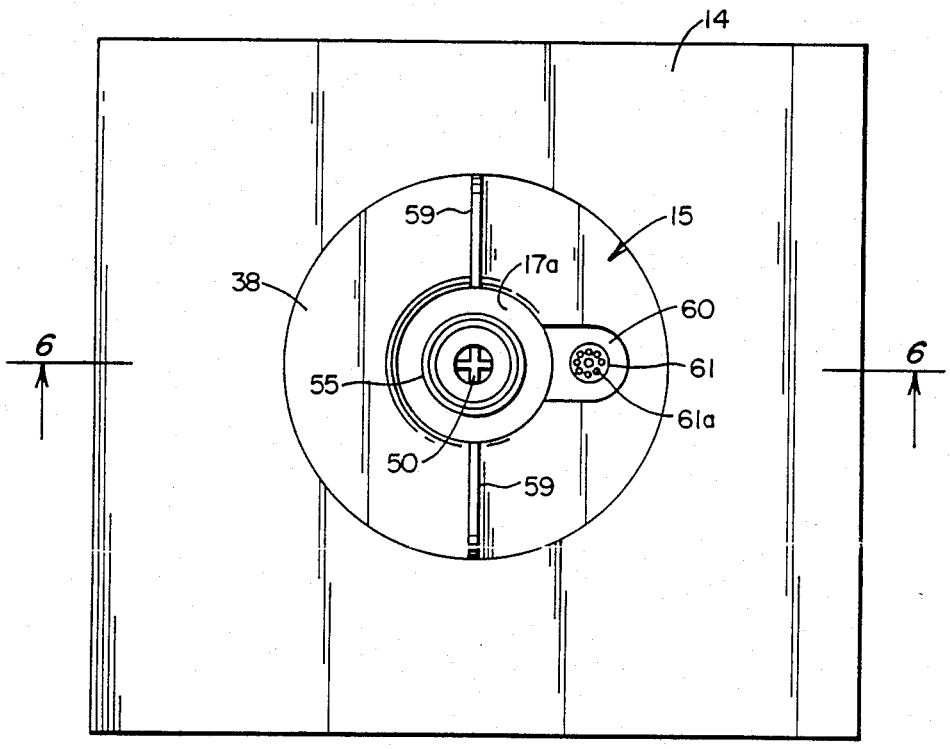
FIG. 5 is a plan view of the bottle-receiving socket and valve assembly mounted at the top of the reservoir of the dispenser.

The ring 38 has central depending bottle-neck receiving socket 17*a* which opens upwardly to receive snugly the bottle neck 17. The socket is additionally supported by annular gussets 46 which extend down along the sides of the socket. The socket 17*a* receives the inserted bottle neck 17 with a tight fit on skirt 21 to produce an effective hermetic seal. The bottom of the socket 17*a* is substantially closed by a heavier socket bottom 49 which serves as a guide for a valve stem 50. This valve stem is shaped (FIG. 5) to permit flow of liquid past it, and the bottom itself is also provided with flow passages 51. The stem 50 is part of an inlet valve for the reservoir 16 and is normally biased in a closed position by a compressible spring 52 which surrounds it and is disposed between a valve head 53 thereon and the bottom 49. This stem has an x-shaped upper guide extension 54 which is mounted for vertical reciprocation in the valve guide 55 upstanding from the supporting bottom 49. The head 53 carries an O-ring 56 on its upper end which normally seats in a groove in guide 55. Guide 55 is in the form of a sleeve sealed in the socket bottom 49 at an O-ring 57.

The spacing of skirt 42 within the surrounding concentric wall of the reservoir 16 may vary in different models of dispensers, and means is therefore provided to expand the gasket 41 carried by skirt 42 into contact with the surrounding reservoir wall to provide a tight hermetic seal. For this purpose means is provided for producing relative axial movement of the skirt 42 of ring 38 and the flange 37 of plate 14 after the unit 15 is initially positioned on plate 14 over the reservoir 16. This will cause the gasket 41 to be compressed vertically to expand it radially outwardly into tight contact with the wall of reservoir 16 as shown in FIG. 7. This is accomplished by means of reversely-inclined lands 38*a* of the lower surface of the ring extremity 38 and lands 39*a* on the bottom of the recess 39 in the plate 14 as shown best in FIG. 8. The ring 38 carries on its upper surface radially-extending upwardly-projecting handle lugs 59 by means of which the ring 38 can be rotated in the recess 39 relative to the plate 14 to produce the relative axial movement of members 42 and 37 needed to compress the gasket 41.

A small recess or socket 60 (FIGS. 6 and 7) in the upper surface of ring 38 provides space for a filter chamber 61 that has a removable and replaceable filter 61*a* which may be of the 0.3 micron type. The outlet of this chamber is controlled by a duck-bill style check valve 62. The orifice controlled by this valve is for admitting makeup air into the reservoir 16 and bottle 13 when needed and the valve will normally protect against overflow from the reservoir.

In use of the system, the bottle 13 is filled and the cap and valve unit 20 is then applied by forcing it onto the neck 17. A pressure sensitive label may be used over the cap unit to insure a sanitary connection and may be removed immediately before coupling to the socket and valve unit 15 of the cover plate 14. Alternatively, a flanged dust cap 25*a* (FIG. 4A) with a pull-tab 25*b* may be provided in the upper end of slider valve 25 which is removed before coupling. The cap 20 contains the slider valve 25 which has the body 28 which will be closed at all times with the fingers 32 in engagement with cam surface 33 except when coupled to the unit 15. The cap and valve on the bottle assures minimum leakage and maximum sanitation during storage and dispensing.

The bottle neck receiving socket unit 15 is applied to the reservoir 16 initially by inserting the skirt 42 thereof into the annular flange 37 carried by the plate 14 as shown in FIG. 6. The plate 38 is then rotated in the recess 39 of plate 14 to compress the gasket 41 as indicated. This causes the gasket to expand radially to tightly seal between the wall of reservoir 16 and the skirt 42 to hermetically seal the unit 15 in the reservoir 16. At this time the valve stem 50 is biased into closed position by the spring 52, the valve head 53 being seated at the O-ring 56 with the stem extension 54 projecting upwardly from the guide 55 but being still within the socket 17*a*. The check valve 62 will be closed normally to prevent overflow from the reservoir. This air handling system is important to controlling reservoir overflow which may be caused after the bottle neck is inserted in unit 15 by cracked bottles admitting make-up air. If the crack is small enough to admit air without dispensing liquid, the liquid will not exit the reservoir 16 and overflow because of the hermetic seal between the reservoir 16 and the unit 15 which is also maintained at the valve 62 until make-up air is needed. If the crack is sufficiently large to permit liquid to escape, it will collect in the bottle neck socket 17*a* and/or on plate 14 and the bottle can be removed before it causes any damage.

In positioning the filled and capped bottle 13 on the unit 15 carried by plate 14, the bottle is inverted as shown in FIG. 6 and positioned over the upwardly-opening socket 17*a* in axial alignment therewith. The bottle is then lowered so that the neck 17 thereof is positioned tightly in the socket 17*a* and is hermetically sealed therein at 23*b* and 23*a* (FIG. 7). These seals are important to assure a continued seal should a leak occur between the slider valve 25 and guide 22 and thus prevent overflow at the socket or well 17*a* due to a cracked bottle. During insertion of the cap 20 into socket 17 sealing lip 21*b* engages and seals against the wall of socket 17*a*. As the neck 17 drops into the socket 17*a*, the valve body 28 slides over the upstanding valve guide 55 and the downward protuberance 26*a* in the outlet slider valve body 28 is engaged by the upper end of valve stem extension 54 so that the valve body is moved to open position where outlet orifices 30 are exposed to permit flow of liquid from the bottle and air into the bottle. At substantially the same time, preferably an instant before, the valve head 53 on stem 50 of the reservoir inlet valve is unseated with its O-ring 56 to allow flow of liquid into the reservoir 16. The flow will be from the bottle 13 through orifices 30 and valve guide 55 into the reservoir 16. When the bottle is removed by pulling its neck 17 upwardly from the socket 17*a*, the spring 52 moves the stem automatically upwardly to seat the valve head 53 and the slider valve body 28 is moved positively into closed position by the interbutting valve stem guide 55 positively pulling the slider sleeve valve 28 axially outwardly into closed position due to its positive connection thereto through the gripping fingers 31 having their locking shoulders 32 positioned in the locking groove 55*a* in the valve stem guide 55. Thus, the outlet valve body 28 in the cap 20 is positively closed when the bottle 13 is removed from the reservoir 16. Thus, the clean and sanitary facilities are continued after the bottle 13 is empty and removed from the dispenser 10 in that the cap valve 28 is closed and deters the invasion of vermin, insects and bacteria. Bottles returned with the cap 20 removed or the valve thereof opened will immediately cause suspicion as to the possibility that the bottle has been used to contain other undesirable liquids. The cap 20 is designed to be almost impossible to remove intact but may be removed by a suitably designed decapitator.

It will be apparent from the above that this system uses a cap and valve assembly which hermetically seals the bottle until it is to be positioned in cooperation with the reservoir of the dispenser. This cap assembly includes the normally-closed bottle outlet valve in the form of a slider valve member. The cap outlet valve is automatically opened when the inserted neck of the bottle is inserted into a socket leading into the reservoir and is becomes hermetically sealed in that socket. The socket is complemental to the capped bottle neck so that the neck will fit tightly therein and the bottle will not tend to tilt relative to the upstanding guide for the valve stem of the reservoir inlet valve. Also, in preventing this tilting the seals between the capped bottle neck and the socket and the slider valve of the cap with the valve guide of the reservoir inlet valve will not be disturbed. That socket is provided with a slidable valve stem to engage the cap slider valve to open it and which also controls substantially simultaneously the unseating of a reservoir inlet stem valve to permit flow of liquid from the bottle into the reservoir. When the bottle neck is withdrawn from the reservoir socket, the slider valve in the cap is positively moved to closed position and the reservoir inlet stem valve is allowed to close.

This system provides a method whereby the bottle is hermetically sealed after filling and until it is mounted on the top of the dispenser reservoir which itself is hermetically sealed until the neck of the bottle is inserted in the socket associated therewith. At that time the outlet valve on the bottle is automatically opened while substantially simultaneously the inlet valve for the reservoir is opened. Upon removal of the bottle from the dispenser the inlet valve of the reservoir closes and the outlet valve of the bottle is positively closed. Thus, sanitary conditions are maintained from the filling of the bottle and until its return.

Having thus described the invention what is claimed is:

1. In combination a container for liquid having a projecting neck through which the liquid is dispensed, a cap and valve assembly for said neck, said cap and valve assembly having an outwardly opening socket for receiving the neck and a valve guide, a slider valve slidably mounted within the valve guide and controlling flow of liquid from the neck, a dispenser having an upwardly-opening reservoir for receiving said liquid, said reservoir having an annular wall, a neck-receiving socket member having a depending annular skirt depending into said reservoir and spaced from said annular wall, said socket member having a socket for receiving said neck which has an outlet, a slidable valve for controlling said outlet, said slidable valve comprising an upstanding guide and a slidable valve stem therein projecting upwardly above the guide, said stem having a valve head thereon, said upstanding guide having a seat, and a spring on said guide which normally biases the head onto said seat, and sealing means between the annular skirt on the socket member and the annular reservoir wall for providing an hermetic seal therebetween, said sealing means being in the form of a flexible gasket of C-cross-section, and means for expanding the gasket, said expanding means comprising means for producing relative axial movement between the annular skirt on the socket member and the annular wall of the reservoir.

2. The combination of claim 1 in which said means for producing axial movement includes reversely-inclined lands carried by the annular skirt and the annular wall of the reservoir.

3. The combination of claim 1 in which said gasket has upper and lower sides and is positioned on the said annular skirt on the socket member by a positioning ring located at a fixed axial position thereon and which engages the gasket at its lower side and a gasket-compressing ring fixed axially relative to said annular wall of the reservoir and surrounding said skirt to permit axial movement of the sleeve relative to said ring and engaging the gasket at said upper side.

4. In combination a container for liquid having a projecting neck through which the liquid is dispensed, a dispenser having an upwardly opening reservoir for receiving said liquid, said reservoir having an annular wall, a neck-receiving socket member having an annular skirt depending into said reservoir and spaced from said annular wall, and sealing means between the annular skirt on the socket member and the annular reservoir wall for providing an hermetic seal therebetween, said sealing means being in the form of a flexible gasket expandable into tight engagement with the skirt and wall, and means for expanding the gasket, said expanding means means comprising means for producing relative axial movement between the annular skirt on the socket member and the annular wall of the reservoir.

5. The combination of claim 4 in which said means for producing relative axial movement includes reversely-inclined lands carried by the annular skirt and the annular wall of the reservoir.

6. The combination of claim 4 in which the gasket is of C cross-section with upper and lower sides which are compressed towards each other in expanding the gasket.

7. The combination of claim 4 in which said gasket has upper and lower sides and is positioned on the said annular skirt on the socket member by a positioning ring located at a fixed axial position thereon and which engages the gasket at its lower side and a gasket-compressing ring fixed axially relative to said annular wall of the reservoir and surrounding said skirt to permit axial movement of the skirt relative to said ring and engaging the gasket at the said upper side.

8. In combination a container for liquid having a projecting neck through which the liquid contents is to be dispensed and a dispenser having a reservoir for receiving said liquid when the container is inverted thereon;

a cap and outlet valve assembly on said neck and comprising a guide with a slider outlet valve cooperating therewith for sliding movement between a normally-closed position and an opened position; said guide being disposed within a cap skirt which is spaced therefrom to provide a neck-receiving socket having a seal engaged by the neck, a socket and inlet valve assembly mounted in cooperation with said reservoir, said socket and inlet valve assembly comprising an upwardly-opening neck-receiving socket which receives the neck of said inverted container having the cap and outlet valve assembly, said inlet valve including a slider and a guide therefor disposed within said upwardly-opening neck-receiving socket, said slider normally-closing the inlet valve to close a reservoir inlet leading from the said upwardly-opening socket into said reservoir, said guide of the reservoir inlet valve upstanding from the bottom of the upwardly-opening socket and a valve stem slidably mounted therein and having a valve head normally engaging a seat thereon, said stem projecting upwardly from the inlet valve guide so as to engage the slidable outlet valve in the neck when the neck is inverted in the upwardly-opening socket to move said outlet valve into opened position, engagement of the stem with said slidable outlet valve also moving the stem downwardly in said inlet valve guide to move said valve head away from its seat, a seal between the inlet valve guide and the outlet valve guide, said cap skirt fitting tightly within the said upwardly-opening socket so as to prevent tilting of the container neck within the socket to prevent interference with said seal.

9. The combination of claim 8 in which the slider outlet valve in the guide on the neck has a body in the form of an annular member which is engaged by said stem as the container neck moves into the upwardly-opening socket, said valve stem projecting upwardly beyond the stem guide.

10. The combination of claim 9 in which the downwardly-opening annular member of the outlet valve body has a closed upper side with a downward protuberance engaged by said valve stem extension.

11. The combination of claim 9 in which gripping means is carried on the annular member and is activated upon movement of the inlet valve guide into contact with said member for positively connecting the inlet valve guide and annular member so that as the neck is withdrawn from the upwardly-opening socket the annular member will be moved to closed position.

12. The combination of claim 11 in which the outlet valve guide has a locking groove and the gripping means comprises gripping fingers on the annular member which normally project outwardly and which are engaged by the outlet valve guide as the inlet valve stem contacts the annular member so as to force them inwardly into engagement with said locking groove in said upstanding stem guide.

13. The combination of claim 8 in which the inlet valve guide is in the form of a sleeve communicating with the reservoir inlet, and a spring surrounding the stem and normally biasing the valve head on the seat.

14. The combination of claim 8 in which the reservoir has an annular wall and opens upwardly to receive the socket and inlet valve assembly, said socket inlet valve assembly including a ring which supports the upwrdly-opening socket centrally thereof and a depending concentric skirt which extends downwardly into the reservoir and is spaced from said annular wall and sealing means between the skirt and the annular wall.

15. The combination of claim 14 including sealing means between the container neck and the upwardly-opening receiving socket.

16. The combination of claim 14 in which said sealing means between the concentric skirt and the annular wall comprises an expandable gasket and means for expanding the gasket.

17. The combination of claim 16 in which the gasket is of C-form and embraces the concentric skirt and the gasket has upper and lower sides to be compressed towards each other, said expanding means moving the sides toward each other to expand the gasket outwardly against the annular wall.

18. The combination of claim 17 in which the expanding means comprises rings carried by the annular wall and the concentric skirt respectively to engage the upper and lower sides of the gasket and means for producing relative axial movement of the annular wall and skirt to compress the gasket sides toward each other to expand it between the skirt and the wall.

* * * * *